US006525489B2

(12) United States Patent
Rudolph

(10) Patent No.: US 6,525,489 B2
(45) Date of Patent: Feb. 25, 2003

(54) CIRCUIT ARRANGEMENT FOR OPERATING ELECTRIC LAMPS

(75) Inventor: Bernd Rudolph, Forstern (DE)

(73) Assignee: Osram Sylvania Inc., Danvers, MA (US)

( * ) Notice: Subject to any disclaimer, the term of this patent is extended or adjusted under 35 U.S.C. 154(b) by 0 days.

(21) Appl. No.: 10/025,474

(22) Filed: Dec. 26, 2001

(65) Prior Publication Data

US 2002/0140369 A1 Oct. 3, 2002

(30) Foreign Application Priority Data

Jan. 3, 2001 (DE) ..... 101 00 037

(51) Int. Cl.[7] ..... H05B 41/00
(52) U.S. Cl. ..... 315/225
(58) Field of Search ..... 315/224, 225, 315/226, 209 V, DIG. 7

(56) References Cited

U.S. PATENT DOCUMENTS 4,782,268 A 11/1988 Fähnrich et al. ..... 315/200 R
5,583,399 A * 12/1996 Rudolph ..... 315/291
5,589,740 A * 12/1996 Rudolph et al. ..... 315/291
5,783,911 A * 7/1998 Rudolph et al. ..... 315/225
5,982,159 A * 11/1999 Janczak et al. ..... 323/282
5,994,848 A * 11/1999 Janczak ..... 315/224
6,144,172 A * 11/2000 Sun ..... 315/291
6,194,842 B1 * 2/2001 Canova ..... 315/225
6,194,844 B1 * 2/2001 Jupp et al. ..... 315/289
6,198,231 B1 * 3/2001 Schemmel et al. ..... 315/225

FOREIGN PATENT DOCUMENTS

| | | |
|---|---|---|
| EP | 0 244 644 | 4/1986 |
| EP | 0 682 464 | 5/1994 |
| EP | 0 753 987 | 7/1995 |

* cited by examiner

*Primary Examiner*—Don Wong
*Assistant Examiner*—Minh D A

(57) ABSTRACT

The invention relates to a circuit arrangement for operating electric lamps, the circuit arrangement having an inverter for generating a medium or high-frequency supply voltage for one or more lamps (21) and a starting circuit for the inverter, and also a device for deactivating the starting circuit, the starting circuit comprising a voltage-dependent switching element (34) and a capacitor (33), and the device for deactivating the starting circuit comprising a switching means (35) whose switching path is arranged in parallel with the capacitor (33) of the starting circuit. According to the invention, the device for deactivating the starting circuit has a threshold switch (39) for controlling the switching means (35).

10 Claims, 1 Drawing Sheet

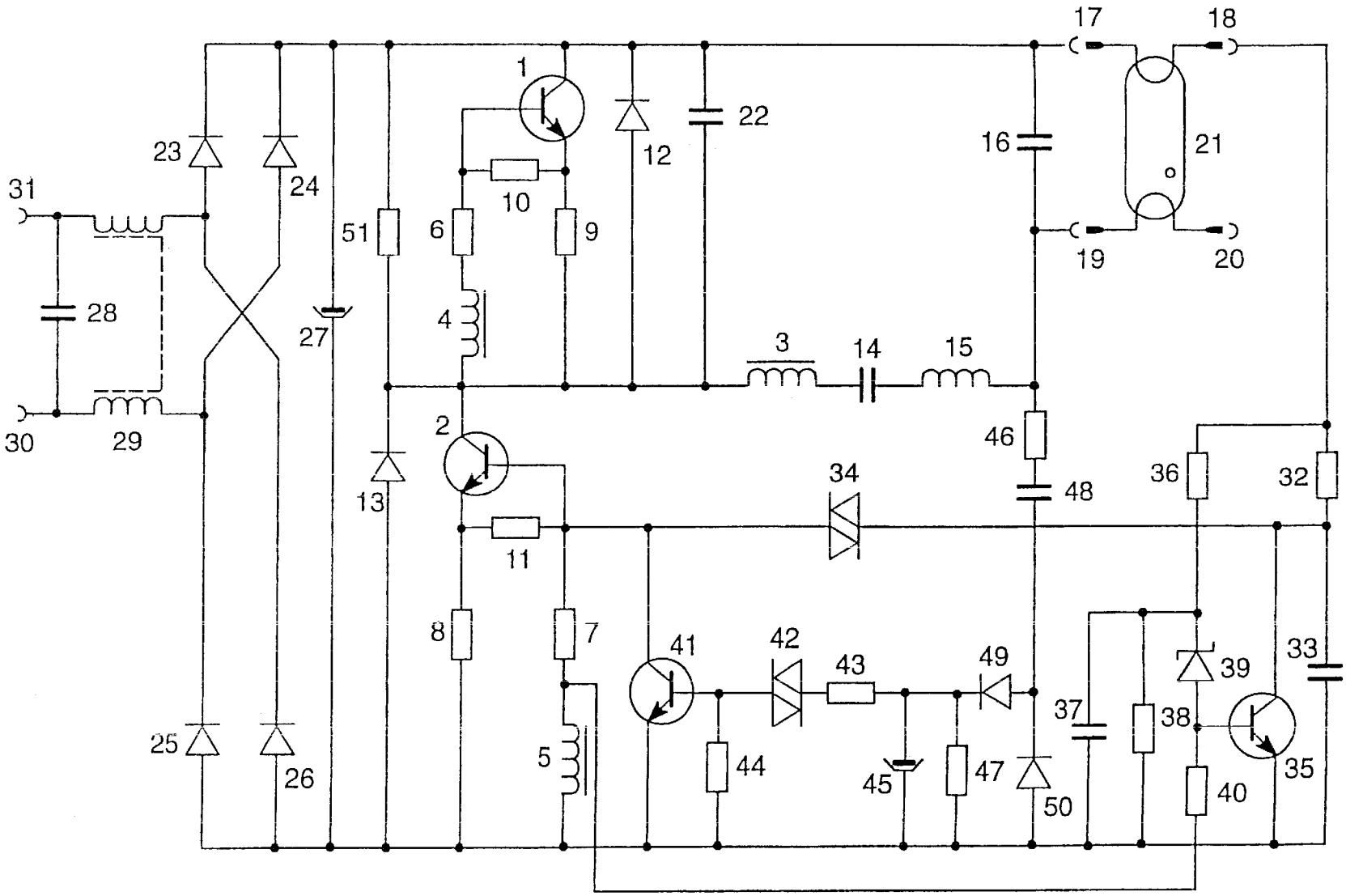
1
2
3
4
5
6
7
8
9
10
11
12
13
14
15
16
17
18
19
20
21
22
23
24
25
26
27
28
29
30
31
32
33
34
35
36
37
38
39
40
41
42
43
44
45
46
47
48
49
50
51

CIRCUIT ARRANGEMENT FOR OPERATING ELECTRIC LAMPS

PRIOR ART

A circuit arrangement of this type is described, for example, in the European publication EP 0 682 464 A1. This publication discloses a self-oscillating inverter having a starting circuit which is used to start the inverter oscillating. In addition, the circuit arrangement also has a device for deactivating the starting circuit. This device contains, as an important element, a transistor whose switching path, when switched on, forms a shunt around the charging capacitor of the starting circuit. After the inverter has begun oscillating, the transistor is switched on and the starting device is deactivated.

The European publication EP 0 753 987 A1 describes a circuit arrangement having an inverter to apply a medium or high-frequency supply voltage to one or more lamps and having a starting circuit which is used to start the inverter oscillation. In addition, this circuit arrangement also has a device for deactivating the starting circuit. This device comprises a resistor and a diode, via which the capacitor of the starting device is discharged after the inverter has begun to oscillate, so that the starting device is not able to produce any further triggering pulses to drive the inverter. In the case of a lamp which is defective or unwilling to fire, the inverter is stopped with the aid of a bistable shutdown device. In order to reset the bistable shutdown device and thus to permit the inverter to be restarted, the voltage supply to the inverter or to the lamp must be interrupted, at least briefly.

SUMMARY OF THE INVENTION

It is an object of the invention to provide a circuit arrangement for operating electric lamps which is improved as compared with the prior art.

According to the invention, this object is achieved by the features of patent claim 1. Particularly advantageous embodiments of the invention are described in the dependent claims.

The circuit arrangement according to the invention has an inverter for generating a medium or high-frequency supply voltage for one or more lamps and a starting circuit for the inverter, and also a device for deactivating the starting circuit, the starting circuit having a voltage-dependent switching means and a capacitor. The device for deactivating the starting circuit has a switching means whose switching path is arranged in parallel with the capacitor of the starting device. In order to control this switching means, the device for deactivating the starting circuit according to the invention is provided with a threshold switch. By means of this measure, deactivation of the starting circuit is ensured even when the inverter does not begin to oscillate. In addition, by means of the threshold switch, a time delay between the generation of the first starting pulse by the starting circuit and the deactivation of the starting circuit is made possible. As a result of the measure according to the invention, it is also possible for a simpler and more cost-effective shutdown device to be used, in order to shut down the inverter in the event of a defective lamp.

In addition, the threshold switch is advantageously arranged in such a way, and the device for deactivating the starting circuit is advantageously constructed in such a way that, after the supply voltage for the inverter has been switched on, the threshold switch is activated with a time delay with respect to the starting circuit. This ensures that the starting circuit is able to generate at least one or two trigger pulses in order to start the inverter oscillating before it is deactivated by means of the threshold switch.

A further advantage of the circuit arrangement according to the invention is that, instead of a bistable shutdown device, a shutdown device constructed as a threshold switch can be used, which is more cost-effective and has a simpler construction. Although the shutdown device constructed as a threshold switch is not bistable and, in particular, is not able to ensure a stable shutdown state without further measures, since the device for deactivating the starting circuit has a means which is used to maintain the deactivated state of the starting circuit when the supply voltage for the inverter is switched on and after the shutdown device has responded, and the device for deactivating the starting circuit interacts with the shutdown device constructed as a threshold switch, the circuit arrangement according to the invention ensures that after the shutdown device has responded, the oscillation of the inverter is terminated permanently, and it is possible to restart the oscillation of the inverter only after the supply voltage for the inverter or for the lamp has been switched on again.

In order to implement the aforementioned time-delayed deactivation of the starting circuit by means of the threshold switch belonging to the device for deactivating the starting circuit, the starting circuit and the device for deactivating the starting circuit advantageously have RC elements of different dimensions. The time constants of the two aforementioned RC elements are coordinated with each other in such a way that after the supply voltage for the inverter has been switched on, the threshold voltage of the trigger component of the starting device is reached earlier than the threshold device of the threshold switch belonging to the device for deactivating the starting circuit. For this purpose, the time constant of the RC element belonging to the starting circuit is advantageously smaller than the time constant of the RC element belonging to the device for deactivating the starting circuit.

In order to achieve a sufficiently short reset period for the device for deactivating the starting circuit, a discharge resistor is advantageously arranged in parallel with the RC element belonging to the device for deactivating the starting circuit, and is used to discharge the capacitor when the supply voltage for the inverter is switched off. The discharge resistor and the capacitor of the aforementioned RC element are dimensioned such that the product of the resistance of the resistor and the capacitance of the capacitor is less than 500 ms and preferably even less than 100 ms. As a result, the aforementioned capacitor is virtually completely discharged after the oscillation of the inverter has decayed.

As a central component, the device for deactivating the starting device has a switching means which is advantageously constructed as a transistor and whose switching path is arranged in parallel with the capacitor of the RC element belonging to the starting circuit, the threshold switch belonging to the device for deactivating the starting device being connected to the control electrode of the transistor and to the capacitor of the RC element belonging to the device for deactivating the starting circuit. In the low-resistance switching state, the switching path of this transistor forms a shunt to the capacitor of the starting device and therefore ensures that the capacitor belonging to the starting circuit is discharged or prevents this capacitor being recharged.

The means already mentioned above which, when the supply voltage for the inverter is switched on and after the shutdown device has responded, is used to maintain the deactivated state of the starting circuit, advantageously comprises an electrical connection between the voltage supply of the inverter and the control electrode of the transistor, the aforementioned electrical connection being routed via the threshold switch belonging to the device for deactivating the starting circuit. As a result, the transistor remains in the switched-on state after the oscillation of the inverter has been terminated by the shutdown device. The starting circuit therefore remains in the deactivated state.

In order to achieve the most immediate deactivation of the starting circuit, after the oscillation of the inverter has started, the control transformer of the self-oscillating oscillator (or an additional winding on a lamp inductor) is used, its primary winding being arranged in a load circuit of the inverter and its secondary winding being used to drive the control electrode of the transistor belonging to the device for deactivating the starting circuit. With the aid of the transformer, the start of the inverter oscillation is monitored and the aforementioned transistor is driven appropriately.

BRIEF DESCRIPTION OF THE DRAWING

Description of the Preferred Exemplary Embodiment

The invention will be explained in more detail below using a preferred exemplary embodiment. The FIGURE shows a schematic representation of a circuit diagram of the preferred exemplary embodiment of the circuit arrangement according to the invention.

The circuit arrangement depicted in the FIGURE is used to operate a low-pressure discharge lamp with an electrical power consumption of about 18 W. This circuit arrangement has a self-oscillating half-bridge inverter, which is substantially formed by the alternately switching transistors 1, 2 and the freewheeling diodes 12, 13 and the toroidal transformer 3–5. The toroidal transformer 3–5 is used to control the transistors 1 and 2. For this purpose, the primary winding 3 of the toroidal transformer is arranged in the load circuit, constructed as a series resonant circuit, of the half-bridge inverter, while the secondary windings 4 and 5 are in each case connected via a base bias resistor 6 and 7 to a base electrode of a half-bridge inverter transistor 1 and 2. The control device for the transistors 1 and 2 is completed by the emitter resistors 8 and 9, the resistors 10, 11 and the capacitor 22, which reduces the switching losses in the transistors 1, 2. The load circuit is connected to the center tap between the transistors 1, 2 of the half-bridge inverter. In addition to the primary winding 3 of the toroidal transformer, it contains a coupling capacitor 14, a resonance inductor 15 and a resonance capacitor 16. The terminals 17–20 for the electrode filaments of the low-pressure discharge lamp 21 are arranged in such a way that the discharge path of the low-pressure discharge lamp 21 is connected in parallel with the resonance capacitor 16. The voltage supply to the half-bridge inverter is provided by rectifying the alternating mains voltage with the aid of a bridge rectifier comprising four diodes 23–26 and a capacitor 27, which is arranged in parallel with the direct current output from the bridge rectifier 23–26. A smoothed DC voltage is therefore provided on the capacitor 27 as a voltage supply for the half-bridge inverter. The coupling capacitor 14 is charged up via the resistor 51 after the voltage supply has been switched on. A filter circuit which comprises a capacitor 28 and a current-compensated inductor 29 and which is connected to the mains voltage connections 30, 31 and to the alternating current input of the bridge rectifier 23–26 is used to suppress the radio interference from the circuit arrangement. In addition, the circuit arrangement has a starting device for the half-bridge inverter, which substantially comprises the resistor 32 and the capacitor 33 and the diac 34. The starting circuit is used to initiate the oscillation of the half-bridge inverter, by generating trigger pulses for the base electrode of the transistor 2 after the voltage supply for the half-bridge inverter has been switched on.

The part described above of the circuit arrangement according to the preferred exemplary embodiment is known and, for example, described in the prior art cited at the beginning. The construction and the function of this part of the circuit arrangement are therefore not to be explained in more detail here.

The circuit arrangement further has a device for deactivating the starting circuit and a shutdown device for stopping the half-bridge inverter in the event of a defective lamp. The device for deactivating the starting circuit comprises the transistor 35, whose switching path is arranged in parallel with the capacitor 33 of the starting circuit, the RC element 36, 37, which is connected in parallel with the RC element 32, 33, the resistor 38, which is used to discharge the capacitor 37 when the voltage supply is switched off or interrupted, the Zener diode 39, whose cathode is connected on one side, via the resistor 36 and the terminals 17, 18, and via an electrode filament of the lamp 21, to the positive terminal of the capacitor 27 and on the other side to the terminal of the capacitor 37 that is at higher potential, and whose anode is connected to the base of the transistor 35, and also comprises the base bias resistor 40, via which the base of the transistor 35 is connected to the secondary winding 5 of the toroidal transformer.

The shutdown device for stopping the half-bridge inverter is constructed as a threshold switch and comprises the transistor 41, whose switching path is connected in parallel with the series circuit comprising the base bias resistor 7 of the transistor 2 and the secondary winding 5, the diac 42, which generates trigger pulses for the base of the transistor 41 when it reaches its threshold voltage, the bias resistors 43, 44, the capacitor 45, which is used for the voltage supply of the diac 42 and the base of the transistor 41, the voltage divider resistors 46, 47, with the aid of which a voltage proportional to the operating voltage of the lamp 21 is generated and with the aid of which the threshold voltage for activating the shutdown device is defined, the capacitor 48, which serves to decouple the DC component in the lamp current, and the rectifier diodes 49, 50 serving as current valves.

Suitable dimensioning of the components of the circuit arrangement is indicated in the table.

Immediately after the voltage supply has been switched on, the coupling capacitor 14 is charged up via the resistor 51, and the capacitor 33 of the starting circuit is charged up via the resistor 32. As soon as the voltage drop across the capacitor 33 has reached the threshold voltage of the diac 34, the diac 34 generates trigger pulses for the base of the transistor 2. As a result, the oscillation of the half-bridge inverter is triggered. The two transistors 1, 2 of the half-bridge inverter switch alternately, so that a medium or high-frequency current flows in the load circuit. The frequency of this current is determined by the switching frequency of the transistors 1, 2. Since the load circuit is constructed as a series resonant circuit, the firing voltage required to fire the gas discharge in the lamp 21 can be provided on the resonance capacitor 16 by the resonant peak method. After the gas discharge has been fired, the capacitor 16 is short-circuited by the discharge path of the low-pressure discharge lamp 21, which is then conductive.

The starting circuit is deactivated immediately after the half-bridge inverter begins to oscillate, by means of the primary winding 3 connected into the load circuit and the secondary winding 5 of the toroidal transformer. As soon as the half-bridge inverter has begun its oscillation, a medium or high-frequency current flows in the load circuit and, in particular, through the primary winding 3, and induces in the secondary winding 5 a corresponding voltage for controlling the bases of the transistors 2 and 35. The transistor 35 is therefore switched on via its base bias resistor 40 and, as a result, the capacitor 33 is able to discharge via the transistor 35, so that the threshold voltage of the diac 34 is no longer reached and the diac 34 does not produce any further trigger pulses. Because it is driven by the transformer windings 3, 5, the transistor 35 switches in the same rhythm as the transistor 2. However, the capacitor 33 is not charged up to a noticeable extent as a result.

As has already been disclosed above, the base of the transistor 35 is additionally also driven via the RC element 36, 37 and the Zener diode 39. The capacitor 37 is charged up via the resistor 36 at the same time as the capacitor 33 after the voltage supply has been switched on. Since the time constant of the RC element 36, 37 is greater than the time constant of the RC element 32, 33 of the starting circuit, however, the threshold voltage required for switching on the diac 34 is provided earlier on the capacitor 33 than the threshold voltage required on the capacitor 37 to switch on the Zener diode 39. The diac 34 is therefore able to generate at least one or two trigger pulses for controlling the base of the transistor 2 before the capacitor 37 is charged up to the threshold voltage of the Zener diode 39 and the transistor 35 which is switched on via the Zener diode 39. For the case in which the oscillation of the half-bridge inverter cannot be started by means of the trigger pulses from the diac 34, and therefore control of the transistor 35 by means of the transformer windings 3, 5 is not possible, the transistor 35 is switched on via the Zener diode 39 after the capacitor 37 has been charged up to the threshold voltage of the Zener diode 39, and the capacitor 33 of the starting circuit is discharged via the transistor 35. The starting circuit will therefore be deactivated in any case. After the transistor 35 has been switched on via the Zener diode 39, the transistor 35 remains in the switched-on state, even after the voltage on the capacitor 37 has fallen below the threshold voltage of the Zener diode 39 since the Zener diode 39 is connected to the electrolytic capacitor 27 via the current path which contains the components 5, 40, 39, 36 and the terminals 17, 18 and also the electrode filament of the lamp 21 connected thereto, and, as a result, the on state of the Zener diode 39 is maintained. Only by means of the voltage supply to the circuit arrangement or to the half-bridge inverter being switched on again, or by means of a brief interruption to the aforementioned current path, for example by replacing the lamp 21, can the transistor 35 be turned off and the starting circuit be activated again.

The function of the shutdown device and its interaction with the device for deactivating the starting circuit will be explained in more detail below.

The shutdown device monitors the positive half wave of the alternating voltage component of the operating voltage of the low-pressure discharge lamp 21 by means of the voltage divider resistors 46, 47 and the capacitor 48 and also the rectifier diode 49. The capacitor 48 is conductive only to the alternating voltage component of the lamp operating voltage. The negative half wave of this alternating voltage component is clamped to ground by the diode 50. A voltage that is proportional to the positive half wave of the alternating voltage component of the lamp operating voltage is present across the resistor 47. The capacitor 45 is also charged up to the same voltage value. For the case of a lamp 21 which is defective or does not wish to fire, or for the case where the operating voltage of the lamp 21 has grown excessively as a result of aging, the voltage drop across the capacitor 45 reaches the threshold voltage of the diac 42. The diac 42 then generates trigger pulses for the base of the transistor 41. As a result, the transistor 41 is switched on via the resistor 43, the diac 42 and the base bias resistor 44, and withdraws the control signal from the base of the transistor 2, so that the oscillation of the half-bridge inverter is terminated. The transistor 41 remains switched on only until the capacitor 45 has discharged to such an extent that the voltage drop across the capacitor 45 is less than the threshold voltage of the diac 42. The transistor 41 then returns into the blocked state. Since the starting circuit is deactivated by discharging the capacitor 33 via the switched-on transistor 35, the diac 34 is not able to generate any trigger pulses to start the half-bridge inverter oscillating again. The half-bridge inverter is therefore stopped permanently, although the control signal was withdrawn from the base of the transistor 2 only for a relatively short time interval. In order to permit the half-bridge inverter to begin to oscillate again, the starting circuit must first be reactivated by resetting the transistor 35 into the blocked state. This may be achieved by means of a brief interruption to the voltage supply to the circuit arrangement or by replacing the lamp 21.

Following the interruption of the voltage supply, the period until the oscillation of the half-bridge inverter decays is about 0.5 s to 1 s. The two components 37, 38 are dimensioned such that the capacitor 37 is virtually completely discharged at the end of the oscillation of the half-bridge inverter.

The invention is not restricted to the exemplary embodiment explained in more detail above.

The circuit arrangement according to the invention can, for example, additionally have a temperature compensation element, which is used to adapt the shutdown threshold of the shutdown device to the temperature-dependent burning voltage of the lamp 21. It has been shown that the operating voltage of the lamp can decrease as the temperature increases. In order to adapt the shutdown threshold of the shutdown device accordingly, a temperature compensation element is provided which comprises the appropriately dimensioned parallel circuit comprising a non-reactive resistor and an NTC resistor. This parallel circuit can be integrated into the circuit arrangement according to the invention, for example at the junction which is defined by the components 48, 49, 50.

In addition, a PTC resistor, for example, can be arranged between the terminals 18 and 20 of the circuit arrangement according to the invention, in order to permit preheating of the electrode filaments in the lamp 21 before the gas discharge therein is fired.

Furthermore, the circuit arrangement according to the invention can additionally have a harmonic filter according to European patent EP 0 244 644, in order to ensure a sinusoidal mains current consumption. In this case, the shutdown device can also monitor the voltage drop across the capacitor 27, in addition to the lamp operating voltage, for example by the positive terminal of the capacitor 27 being connected, via a Zener diode polarized in the reverse direction, to the junction defined by the components 43, 45 and 49.

The circuit arrangement according to the invention can additionally also be constructed in such a way that it is suitable for the operation of a plurality of low-pressure discharge lamps connected in series or parallel. The shutdown device according to the invention can in addition also be used in circuit arrangements for operating high-pressure discharge lamps or incandescent halogen lamps.

TABLE

| Dimensioning of the electrical components according to the preferred exemplary embodiment | |
|---|---|
| 1, 2 | BUJ105A |
| 3, 4, 5 | 7/2/2 windings |
| 6, 7 | 6.8 Ω |
| 8, 9 | 0.47 Ω |
| 10, 11 | 33 Ω |
| 12, 13 | BYD33J |
| 14, 28 | 220 nF |
| 15 | 1.5 mH |
| 16 | 10 nF |
| 22 | 3.3 nF |
| 23–26 | 1N4007 |
| 27 | 4.7 μF |
| 29 | 2 × 39 mH |
| 32 | 1.2 MΩ |
| 33, 37 | 100 nF |
| 35 | BC847A |
| 36, 51 | 2 MΩ |
| 38, 44, 47 | 220 kΩ |
| 40 | 68 kΩ |
| 41 | BC368 |
| 43 | 100 Ω |
| 45 | 22 μF |
| 46 | 470 kΩ |
| 48 | 2.2 nF |
| 49, 50 | 1N4148 |

What is claimed is:

1. A circuit arrangement for operating electric lamps, the circuit arrangement having an inverter for generating a medium or high-frequency supply voltage for one or more lamps (21) and a starting circuit for the inverter, and also a device for deactivating the starting circuit, the starting circuit comprising a voltage-dependent switching element (34) and a capacitor (33), and the device for deactivating the starting circuit comprising a switching means (35) whose switching path is arranged in parallel with the capacitor (33) of the starting circuit, characterized in that the device for deactivating the starting circuit has a threshold switch (39) for controlling the switching means (35).

2. The circuit arrangement as claimed in claim 1, characterized in that the threshold switch (39) is arranged in such a way, and the device for deactivating the starting circuit is constructed in such a way, that after a supply voltage for the inverter has been switched off, a reset period of the threshold switch (39) or a reset period of the device for deactivating the starting switch is shorter than the oscillation decay period of the inverter.

3. The circuit arrangement as claimed in claim 2, characterized in that a resistor (38) is arranged in parallel with the capacitor (37) of the RC element of the device for deactivating the starting device, and is used to discharge the capacitor (37) when the supply voltage for the inverter is switched off, the resistor (38) and the capacitor (37) being dimensioned such that a product of the resistance of the resistor (38) and a capacitance of the capacitor (37) is less than 500 ms.

4. The circuit arrangement as claimed in claim 1, characterized in that the threshold switch (39) is arranged in such a way, and the device for deactivating starting switch is constructed in such a way, that after a supply voltage for the inverter has been switched on, the threshold switch (39) is activated with a time delay with respect to the starting circuit.

5. The circuit arrangement as claimed in claim 1, characterized in that the circuit arrangement has a shutdown device which is constructed as a threshold switch and which is used to switch off the inverter in the event of a lamp (21) which is defective or unwilling to fire, and the device for deactivating the starting circuit has a means which, when the voltage supply for the inverter is switched on and after the shutdown device has responded, is used to maintain the deactivated state of the starting circuit.

6. The circuit arrangement as claimed in claim 5, characterized in that the means for maintaining the deactivated state of the starting circuit when the voltage supply for the inverter is switched on, and after the shutdown device has responded, comprises an electrical connection between the voltage supply of the inverter and a control electrode of the transistor (35), a connection being routed via the threshold switch (39) belonging to the device for deactivating the starting circuit.

7. The circuit arrangement as claimed in claim 5, characterized in that a temperature compensation element is provided, which is connected to the voltage input of the shutdown device and which is used to adapt the shutdown threshold of the shutdown device to the temperature-dependent change in the lamp burning voltage.

8. The circuit arrangement as claimed in claim 1, characterized in that the starting circuit has a resistor (32) which, with the capacitor (33) of the starting circuit, forms an RC element, and the device for deactivating the starting device has an RC element (36, 37), the time constant of the RC element (32, 33) of the starting circuit being less than the time constant of the RC element (36, 37) of the device for deactivating the starting device.

9. The circuit arrangement as claimed in claim 8, characterized in that the switching means (35) of the device for deactivating the starting device is constructed as a transistor, whose switching path is arranged in parallel with the capacitor (33) of the RC element (32, 33) belonging to the starting circuit, the threshold switch (39) being connected to the control electrode of the transistor (35) and to the capacitor (37) of the RC element (36, 37) belonging to the device for deactivating the starting circuit.

10. The circuit arrangement as claimed in claim 9, characterized in that the circuit arrangement has a transformer whose primary winding (3) is arranged in a load circuit of the inverter and which has a secondary winding (5) which is used to drive the transistor (35).

* * * * *

UNITED STATES PATENT AND TRADEMARK OFFICE

CERTIFICATE OF CORRECTION

PATENT NO. : 6,525,489 B2 
DATED : February 25, 2003
INVENTOR(S) : Bernd Rudolph It is certified that error appears in the above-identified patent and that said Letters Patent is hereby corrected as shown below:

Title page,
Item [73], Assignee should read: -- Patent-Freuhand-Gesellschaft fur elektrische Gluhlampen mbH. --.

Signed and Sealed this

Tenth Day of February, 2004

JON W. DUDAS
*Acting Director of the United States Patent and Trademark Office*